United States Patent [19]

Yang

[11] Patent Number: 4,781,625

[45] Date of Patent: Nov. 1, 1988

[54] TRANSFERRING DEVICE FOR ELECTRICAL CONNECTORS

[75] Inventor: Yuan-Wei Yang, Taipei, Taiwan

[73] Assignee: Ming Fortune Industry Co., Ltd., Taipei, Taiwan

[21] Appl. No.: 138,954

[22] Filed: Dec. 29, 1987

[51] Int. Cl.[4] ..... H01R 13/50

[52] U.S. Cl. ..... 439/654; 439/724; 439/752

[58] Field of Search ..... 439/638, 650, 651, 652, 439/654, 655, 653, 723, 724, 752

[56] References Cited

U.S. PATENT DOCUMENTS

| | | | |
|---|---|---|---|
| 3,354,421 | 11/1967 | Rodgers | 439/723 |
| 3,508,189 | 4/1970 | Culver | 439/724 |
| 3,705,378 | 12/1972 | Elkins | 439/638 |
| 4,037,912 | 7/1977 | Besser et al. | 439/724 |
| 4,236,779 | 12/1980 | Tang | 439/638 X |
| 4,416,499 | 11/1983 | Frascatore et al. | 439/723 |
| 4,558,919 | 12/1985 | Pohl | 439/638 X |
| 4,588,252 | 5/1986 | Ice | 439/724 |
| 4,592,614 | 6/1986 | Myers | 439/654 |
| 4,611,880 | 9/1986 | Peterson et al. | 439/752 |

FOREIGN PATENT DOCUMENTS

| | | | |
|---|---|---|---|
| 2441559 | 3/1976 | Fed. Rep. of Germany | 439/752 |

*Primary Examiner*—William R. Briggs

*Attorney, Agent, or Firm*—Fleit, Jacobson, Cohn & Price

[57] ABSTRACT

Disclosed is an electrical connector transferring device, comprising: a first plastic member having at least one row of first upper through holes and at least one row of first lower through holes; a second plastic member having at least one row of second upper through holes corresponding with said one row of first lower through holes, and at least one row of second lower through holes corresponding with said one row of first upper through holes; a first intermediate block having a set of first grooves corresponding with to said one row of first upper through holes, and a set of second grooves corresponding with said one row of first lower through holes, said first intermediate block being assembled to said first plastic member; a second intermediate block having a set of third grooves corresponding with said one row of second lower through holes, and a set of fourth grooves corresponding with said one row of second upper through holes, said second intermediate block being assembled between said first intermediate block and said second plastic member; a first set of terminals each of which having two free ends inserted, respectively, into said one row of first upper through holes and said one row of second lower through holes, and a central portion engaged into said first and said third grooves; a second set of terminals each of which having two free ends inserted, respectively, into said one row of first lower through holes and said one row of second upper through holes, and a central portion engaged into said second and said fourth grooves.

4 Claims, 4 Drawing Sheets

TRANSFERRING DEVICE FOR ELECTRICAL CONNECTORS

BACKGROUND OF THE INVENTION

This invention relates to a transferring device for electrical connectors, which is much smaller in size and cheaper to manufacture as compared with a conventional one.

Nowadays, electrical connectors have been very widely utilized in various fields such as computers and communication. Some of the electrical connectors in various computors or instruments are provided with male connectors and the others are provided with female connectors. If a computer or instrument having male (or female) connectors is to be connected to a cable connector which is provided with male (or female) connectors, it will be necessary to interpose a transferring device therebetween. A conventional female connector transferring device 10 provided at its two ends with female connectors 12 and 14 each having twenty five connecting holes is shown in FIG. 1.

In order to illustrate the construction of the conventional transferring device more clearly, FIG. 2 shows the exploded perspective view of an electrical connector transferring device having nine connecting holes, with the intermediate portion thereof being partially removed so as to expose its interior structure. The illustrated transferring device comprises two female connectors 20 and 22. According to common practice in the field of electrical connectors, the connecting holes (or terminals) of a female connector are numbered from the right to the left as viewed from its front side, whereas those of a male connector are from the left to the right. Namely, if we take the connectors shown in FIG. 2 as an example, the receiving ends of the female connector 20 are numbered from 1 to 9 consecutively from the right to the left, while the corresponding receiving ends (or terminals) of the female conector are numbered from 1' to 9' consecutively in the opposite direction. For the purpose of connecting the two connectors 20 and 22 in an one-to-one manner, i.e. the numerals 1, 2 - - - - 9 corresponding to the numerals 1', 2'- - - - - 9', respectively, two conventional methods have been adopted in the past. The first method is to connect each corresponding terminal pair with a wire and then fill the cavities formed among the wires with plastic so as to insulate the connection wires from one another and to enclose the connecting portion between the two female connectors 20 and 22. However, since the size of each electrical connector is very small and since the adjacent terminals are quite close to one another, the welding operation of the connection wires will be very difficult and time-consuming. Besides, since most of the connection wires must intersect with one another as can be understood from FIG. 2, the degree of difficulty in welding the wires is further increased. Accordingly, the manufacturing cost of such conventional transferring device is unavoidably high. In addition, since the connection wires between the connectors 20 and 22 intersect with one another, a considerable amount of plastic must be filled into the resulting cavities, thus inflating not only the size of the connector but also its manufacturing cost.

The second method is to engage the two side edges of a printed circuit board, respectively, into between the two rows of terminals on the back side of the electrical connector 20, and into between the two rows of terminals on the back side of the electrical connector 22 so that the two connectors 20 and 22 can be connected in an one-to-one manner by the use of the circuits formed on the printed circuit board. Finally, the connecting portion including the printed circuit board is enclosed by plastic. Though the assembling operation according to this second method is easier than the above one, the necessity of producing printed circuit boards will greatly inflate the manufacturing cost. Besides, the product is still bulky and thus a lot of plastic must be utilized.

Taking into consideration the aforementioned deficiencies, the primary object of this invention is to provide an electrical connector transferring device which is compact in size, easy to assemble and low in manufacturing cost.

The various features and advantages of this invention can be more fully understood by the description with respect to a preferred embodiment in conjunction with the accompanied drawings, wherein.

Figure 1:
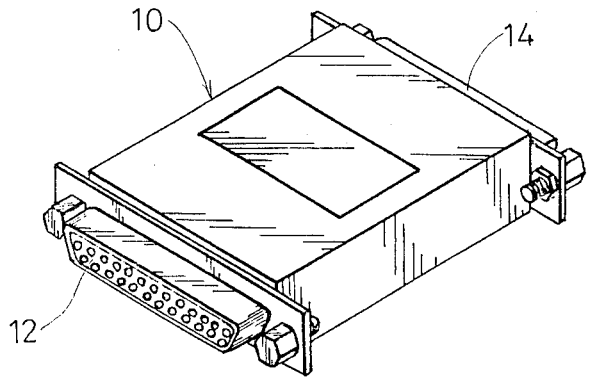
Fig. 1 (PRIOR ART)
FIG. 1 is the perspective view of a conventional electrical connector transferring device.
Figure 2:
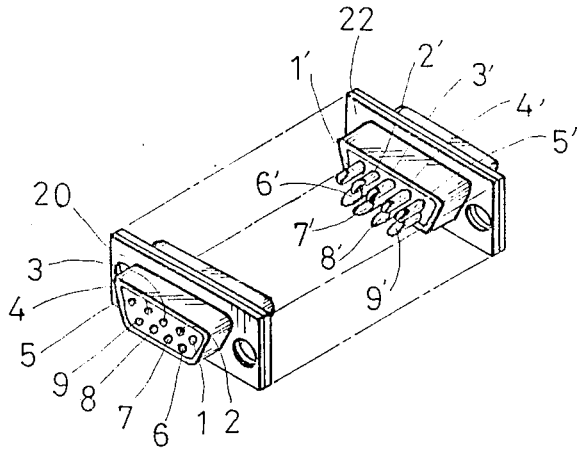
Fig. 2 (PRIOR ART)
FIG. 2 is the exploded perspective view of another conventional electrical transferring device with the intermediate portion of the transferring device being removed so as to expose the interior thereof.
Figure 4:
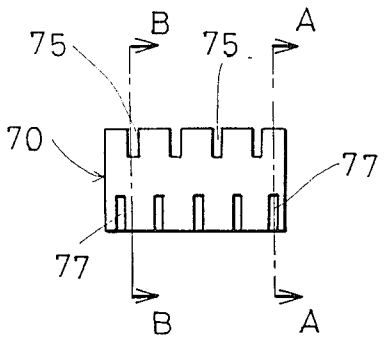
FIG. 4 is the end view of an intermediate mechanism in the transferring device of FIG. 3.
Figure 3:
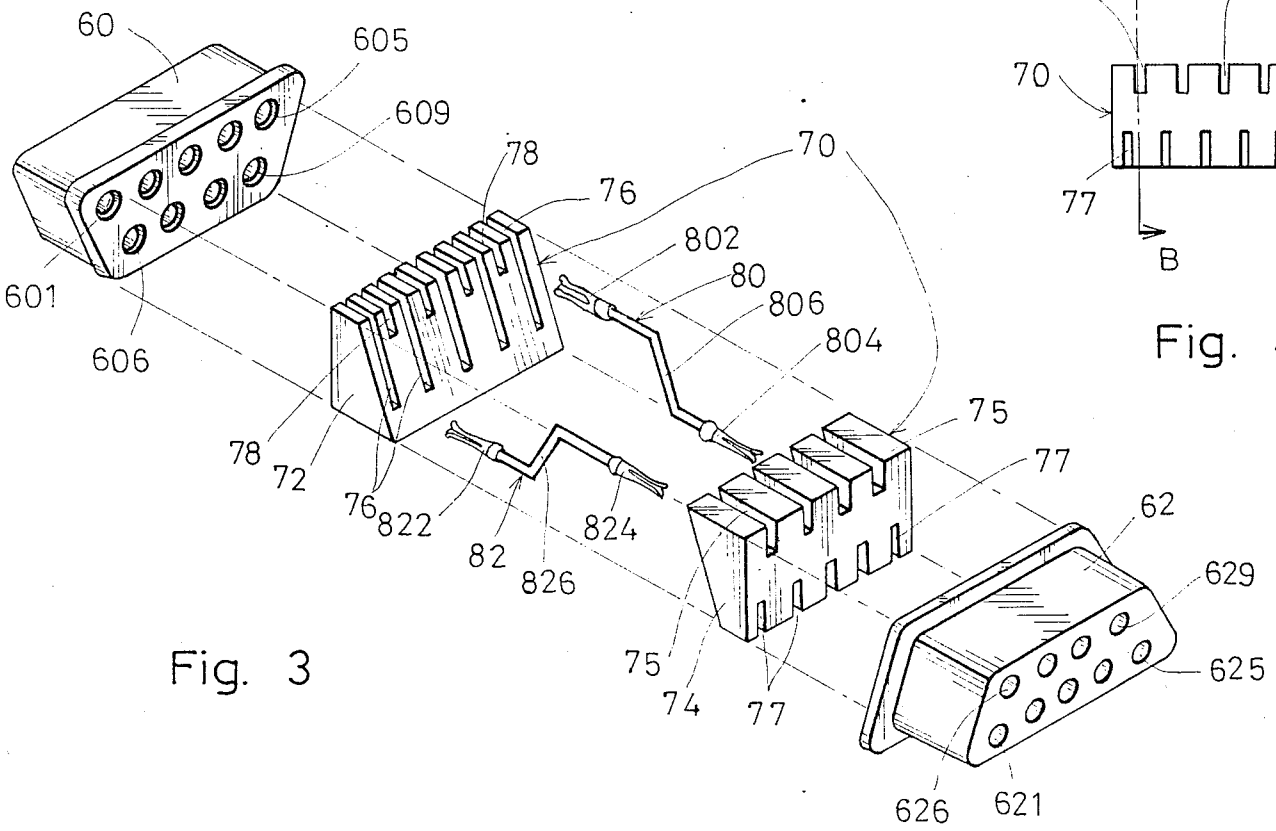
FIG. 3 is the exploded perspective view of part of a transferring device according to the first embodiment of this invention.
Figure 9:
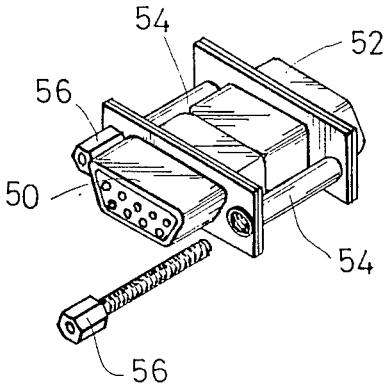
FIG. 9 is a perspective view showing the first embodiment of this invention in an assembled state.

Referring now to FIGS. 3, 4 and 9, according to the first embodiment of this invention, the electrical connector transferring device comprises two metal shells 50 and 52, two plastic members 60 and 62, an intermediate mechanism 70 including two intermediate blocks 72 and 74, and a plurality of terminals 80 and 82. In FIG. 3, only one pair of terminals 80 and 82 among totally nine pairs is shown and the metal shells 50 and 52 are omitted for clearer illustration. The plastic member 60 is formed with nine through holes which are numbered in a way as shown in FIG. 3. Namely, the upper row of through holes are numbered 601 to 605 from the left to the right, and the lower row of through holes are numbered 606 to 609 from the left to the right. The two plastic members 60 and 62 are of the same shapes, but arranged in a spaced and back-to-back manner. The orientation of the plastic member 62 is decided by rotating the plastic member 60 by 180 degrees around a line connecting the upper (or lower) row of through holes. Accordingly, the nine through holes of plastic member 62 should be numbered in a manner as shown in FIG. 3. Namely, the lower row of through holes are numbered 621 to 625 from the left to the right, and the upper row of through holes are numbered 626 to 629 from the left to the right. Consequently, each corresponding pair of holes in the two plastic members 60 and 62 are located in the same vertical plane with one hole of each corresponding pair being located in the upper row, and the other hole of same pair in the lower row.

According to this invention, in order to connect the through holes of the two plastic members 60 and 62 in an one-to-one and non-intersecting manner, an intermediate mechanism 70 comprising two intermediate blocks 72 and 74 is provided. The intermediate block 72 is provided with one set of five juxtaposed grooves 76 each of which is aligned at its top portion with one of the upper row through holes 601 to 605 of the plastic member 60, and also provided with another set of four juxtaposed grooves 78 each of which is aligned at its lower portion with one of the lower row through holes 606 to 609. The intermediate block 74 is provided, at its upper portion, with one set of four juxtaposed grooves 75 each of which corresponds with one of the groove 78 and with one of the upper row through holes 626 to 629 of the plastic member 62, and also provided, at its lower portion, with another set of five grooves 77, each of which corresponds with one of the grooves 76 and with one of the lower row through holes 621 to 625 of the plastic member 62. The shapes of each grooves 75, 76, 77 and 78 are as shown in FIGS. 5 and 6.

The terminal 80 comprises a pair of connecting heads 802 and 804 at its two free ends, and a central portion 806 formed of a thin metal piece. The connecting heads 802 and 804 can be inserted, respectively, into the through holes 605 and 625 of the plastic members 60 and 62, while the central portion 806 can be engaged into the grooves 76 and 77 (see FIG. 5). Similarly, the terminal 82 is provided, at its two free ends, with a pair of connecting heads 822 and 824 which can be inserted, respectively, into the through holes 606 and 626 of the plastic members 60 and 62, and a central portion 826 which can be engaged into the grooves 78 and 75 (see FIG. 6). Thus, the one-to-one connection between the two plastic members 60 and 62 can be achieved. The terminals 80 and 82 can be integrally made from a sheet metal (say sheet copper) by press work.

Figure 5:
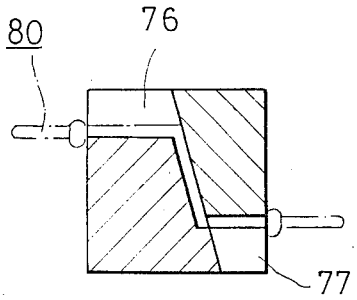
FIG. 5 is a cross-sectional view taken along line A—A in FIG. 4.
Figure 6:
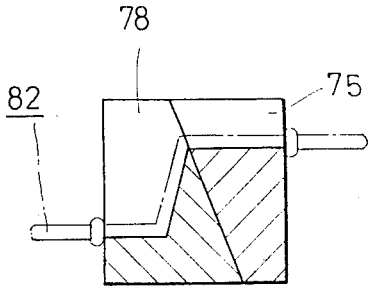
FIG. 6 is another cross-sectional view taken along line B—B in FIG. 4.
Figure 7:
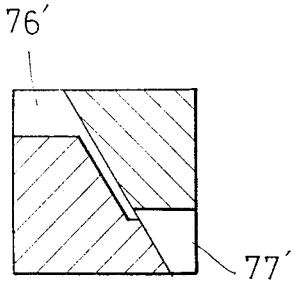
FIG. 7 is a cross-sectional view similar to FIG. 5, showing another example of intermediate mechanism.
Figure 8:
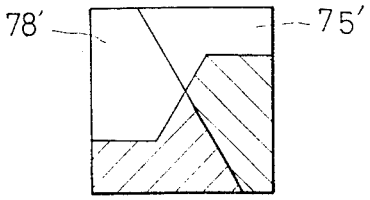
FIG. 8 is a cross-sectional view similar to FIG. 6, showing the same example of intermediate mechanism as FIG. 7 but taken along different lines.

The shapes of the grooves 78, 76, 77 and 78 are not necessarily confined to those as shown in FIGS. 5 and 6. For example, the shapes of another set of grooves 75', 76', 77' and 78' can also be adopted. Such and similar modifications should also belong to the scope of this invention.

The electrical connector transferring device of this invention is assembled by : engaging the five terminals 80 into the grooves 76 of the intermediate block 72, and engaging the four terminals 82 into the grooves 75 of the intermediate block 74; bonding the two intermediate blocks 72 and 74 together; mounting the two plastic members 60 and 62 so that each connecting head of the terminals is inserted into its corresponding through hole; enclosing two metal shells 50 and 52 around the two plastic members 60, 62 and the intermediate mechanism 70; and attaching two metal tube 54 having inner threads to the two metal shells 50 and 52 so that the two metal shells can be fastened together by two screws 56 as shown in FIG. 9. Those skilled in this art can certainly appreciate that other fastening methods instead of the above-described may also be applied to this invention.

Figure 10:
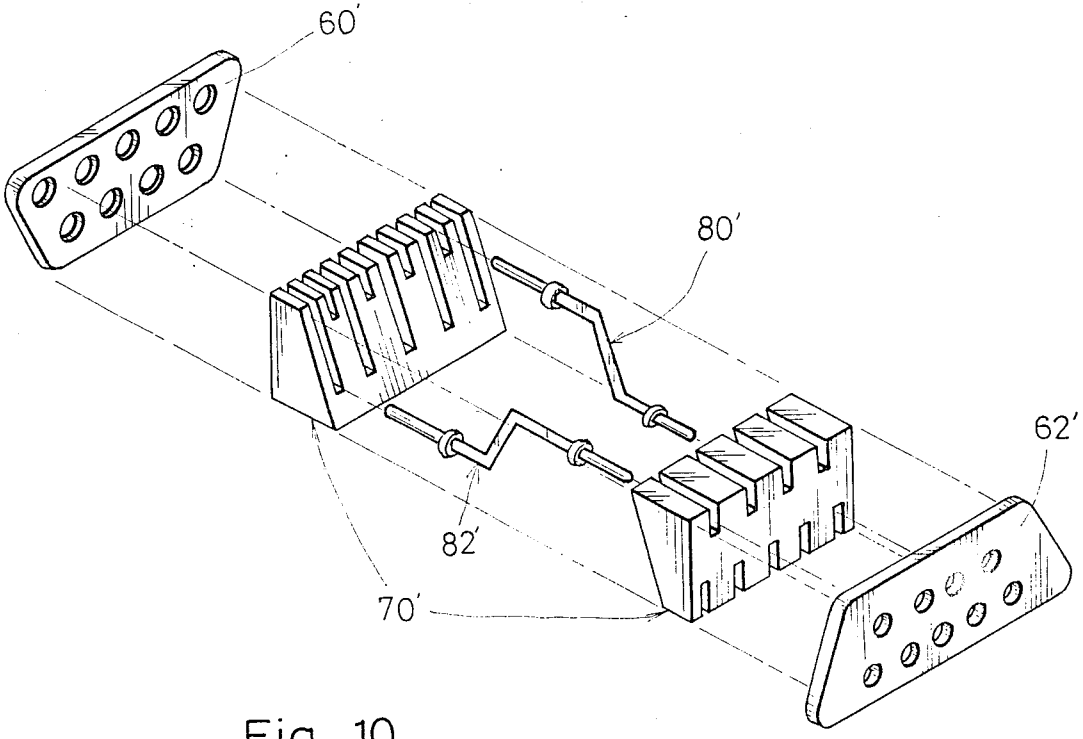
FIG. 10 is an exploded perspective view showing part of the second embodiment of this invention.

Though this invention has been described with respect to a female connector transferring device, similar description can also be made with regard to a male connector transferring device, such as the example shown in FIG. 10 wherein only the plastic members 60', 62' and the terminals 80', 82' are slightly changed as compared with the example shown in FIG. 3. Besides, while the above description has been made with respect to the case of a 9-hole ( or 9-pin ) female ( or male ) connector transferring devices, those skilled in the art can certainly appreciate that this invention may also be applied to the case of connector transferring devices having 15, 19, 23, 25, 37, 14, 24, 36 or 50 pins ( or holes ).

While this invention has been described with respect to a preferred embodiment, it is to be understood that the invention is not to be limited to the disclosed embodiment but, on the contrary, is intended to cover various modifications and equivalent arrangements included within the spirit and scope of the appended claims.

I claim:

1. An electrical connector transferring device, comprising:

a first plastic member having at least one row of first upper throughholes and at least one row of first lower through holes;

a second plastic member having at least one row of second upper through holes corresponding with said one row of first lower through holes, and at least one row of second lower through holes corresponding with said one row of first upper through holes;

a first intermediate block having a set of first grooves corresponding with said one row of first upper through holes, and a set of second grooves corresponding with said one row of first lower through holes, said first intermediate block being assembled to said first plastic member;

a second intermediate block having a set of third grooves corresponding with said one row of second lower through holes, and a set of fourth grooves corresponding with said one row of second upper through holes, said second intermediate block being assembled between said first intermediate block and said second plastic member;

a first set of terminals each of which having two free ends inserted, respectively, into said one row of first upper through holes and said one row of second lower through holes, and a central portion engaged into said first and said third grooves;

a second set of terminals each of which having two free ends inserted, respectively, into said one row of first lower through holes and said one row of second upper through holes, and a central portion engaged into said second and said fourth grooves.

2. An electrical connector transferring device as claimed in claim 1, wherein each of said central portions of said first and said second sets of terminals is formed of a thin metal sheet.

3. An electrical connector transferring device as claimed in claim 2, wherein each of said first and said second sets of terminals is integrally formed.

4. An electrical connector transferring device as claimed in claim 3, further comprising a first metal shell which enclosing and securing said first plastic member and said first intermediate block therein, and a second metal shell which enclosing and securing said second plastic member and said second intermediate block therein, said second metal shell being fixed to said first metal shell.

* * * * *